US008741074B1

(12) United States Patent
Ding et al.

(10) Patent No.: US 8,741,074 B1
(45) Date of Patent: Jun. 3, 2014

(54) CHEMICAL CONVERSION COATINGS FOR CORROSION PROTECTION OF COPPER AND OTHER ALLOYS IN CONTAMINATED WATER

(75) Inventors: Hongbo Ding, Bridgewater, NJ (US); Jiong Liu, East Brunswick, NJ (US)

(73) Assignee: NEI Corporation, Somerset, NJ (US)

( * ) Notice: Subject to any disclaimer, the term of this patent is extended or adjusted under 35 U.S.C. 154(b) by 477 days.

(21) Appl. No.: 13/017,625

(22) Filed: Jan. 31, 2011

Related U.S. Application Data

(60) Provisional application No. 61/417,542, filed on Nov. 29, 2010.

(51) Int. Cl.
*C23C 22/48* (2006.01)
*C23C 22/52* (2006.01)
*C23C 22/05* (2006.01)

(52) U.S. Cl.
USPC ..... 148/282; 148/243; 106/14.11

(58) Field of Classification Search
CPC ..... C23C 22/48; C23C 22/50; C23C 22/52; C23C 22/53; C23C 22/54; C23C 22/56; C23C 22/57; C23C 22/58
USPC ..... 148/282, 243; 106/14.11
See application file for complete search history.

(56) References Cited

U.S. PATENT DOCUMENTS

2007/0163677 A1* 7/2007 Ein-Eli et al. ..... 148/269

* cited by examiner

*Primary Examiner* — Lois Zheng
(74) *Attorney, Agent, or Firm* — William L. Botjer

(57) ABSTRACT

A non-chromate conversion coating for copper or other alloys. The conversion coating is composed of hydrotalcite-like compound (HTlcs). The conversion coating adheres well with the alloys, and provides excellent corrosion protection. In addition, corrosion inhibitive species were incorporated into the coating. The coating with inhibitors incorporated showed damage-responsive properties. The corrosion protection property of the conversion coating was further enhanced through applying a surface sealer. The coating has applicability in industrial heat exchangers that use reclaimed water.

17 Claims, 15 Drawing Sheets

CHEMICAL CONVERSION COATINGS FOR CORROSION PROTECTION OF COPPER AND OTHER ALLOYS IN CONTAMINATED WATER

STATEMENT OF GOVERNMENT SUPPORT OF INVENTION

The work leading to the present application was done as part of EPA Grant Number: EP-D-10-038, the government has certain rights in this invention.

CROSS REFERENCE TO RELATED APPLICATIONS

This application claims priority from U.S. Provisional application Ser. No. 61/417,542 filed Nov. 29, 2010, the disclosure of which is hereby incorporated by reference.

BACKGROUND OF THE INVENTION

Presently, there is a rapidly growing need to use alternate water sources for non-potable applications. The projected population growth and limited availability of fresh water sources have forced utility companies and industries to evaluate the use of alternate water (e.g. recycled water, produced waters and other impaired sources) for non-potable water applications such as industrial and commercial cooling.

However, a key limitation in the use of such alternate water sources is the corrosion of pipe materials, such as copper alloys, due to the presence of high levels of dissolved salts (1000 to 400,000 mg/l sodium chloride in produced waters). The presence of dissolved salts causes the water to have ionic conductivity, and facilitates electrochemical corrosion pathways. In addition to dissolved salts, some reclaimed and produced waters also contain highly oxidative metal ions and ammonia (1 to 30 mg/l). The dissolved oxidative metal ions promote corrosion of many metals. The presence of ammonia aids the corrosion of copper alloys in particular. Frequent replacement of corroded tubes, and associated facility shutdown, make it very expensive to use alternate waters. Hence, successful use of these non-traditional water sources for cooling applications will require either (i) a treatment process for sodium chloride, oxidative metal ions and ammonia removal, or (ii) an anti-corrosion metal surface treatment.

Most of the feasibility and pilot studies performed to date to use alternate water sources have evaluated either treating the water, or adding corrosion control chemicals to meet the water quality requirements of the piping materials for corrosion control. Upon evaluation, these studies deemed this approach to be not viable due to either (i) high cost of treatment required to remove dissolved salts (~$3000 per acre foot), or (ii) the environmental implications of discharging a large quantity of corrosion inhibitors (needed, in particular, for untreated alternate waters) such as 2-mercaptobenzimidazole and benzotriazole in blowdown streams into a large water body.

For example, an industrial facility in the Pacific Northwest has five chillers (three 1500 Ton, one 1200 Ton and one 500 Ton) to meet its cooling needs. A few years ago, in an effort to promote alternate water for cooling, this facility retrofitted two of their chillers to operate in once-through cooling mode using secondary treated wastewater (ammonia conc. ~20 to 30 mg/l) from the local wastewater treatment plant. However, the Cu—Ni condensers of these chillers experienced significant corrosion within a short period of time. Simultaneous coupon studies performed showed severe corrosion of copper (0.5 mpy), copper nickel (0.3 mpy) and mild steel (10.5 mpy) coupons after six months of exposure. While chemical treatment such as breakpoint chlorination may be viable for waters with relatively small amounts of ammonia (~1 to 2 mg/l), it is not a viable option for waters containing higher amounts of ammonia due to economic and environmental (e.g. THM formation potential) constraints. Hence, the industrial facility predominantly uses their fresh water chillers to meet their cooling demand. The once-through, reclaimed water chillers are operated sporadically when the fresh water systems do not meet the cooling needs (typically less than a month in a year).

Also, a DOE funded study (DE-FC26-03NT41906) evaluated the treatment and use of oilfield produced water for power plant cooling needs for San Juan Generation Station (SJGS) near Farmington, N. Mex. This region is facing significant water scarcity, has a large water demand for power plant cooling and generates produced water from many oil and coal bed methane (CBM) wells. A detailed demonstration study estimated a cost of $4,500/MG for treating the water for corrosion causing constituents such as dissolved salts and ammonia (in addition to approximately $ 22M for pipeline to deliver the treated water). Due to the high cost of treatment, the plan to construct a full-scale facility had to be suspended. The power plant still uses fresh water for cooling needs.

The two examples described above demonstrate the strong need for new strategies to overcome the problem of corrosion, thereby facilitating the use of alternate waters for power plant and industrial cooling applications. The use of polymer coatings to extend the lifetime of heat exchanger tubes in highly corrosive alternate water environments has been investigated in the past. Florida Power Corporation (FPC) and Electric Power Research Institute (EPRI) conducted a joint research program to evaluate existing commercial polymer coatings for condenser tubes by using seawater as cooling agent. The research did not identify a useful coating system, either because of the high heat transfer resistance or because of the poor stability of the coating. The high heat transfer resistance resulted from the difficulty in applying a thin layer of organic coating on the internal surface of the tubes. The poor stability of the coating was often related to the problem of poor adhesion. In another research conducted by CorrView International, a proprietary epoxy coating was applied onto the internal surface of heat exchanger tubes. The coating thickness was approximately 4-6 mils. No significant loss of heat transfer efficiency was measured. The application of the coatings required specialized equipment to sand blast the internal surface of the tube, and other sophisticated procedures that required several days of work. Recently, polymer coatings have been introduced (e.g., GenGard 8000) that address scaling issues with poor quality waters. These coatings, however, are not self-healing coatings and do not address the corrosion problem directly.

SUMMARY OF THE INVENTION

In contrast to state of the art coating technologies, our solution to the problem is a sub-micron thick chemical conversion coating that adheres firmly to the internal surface of the heat exchanger tube. A chemical conversion coating or pretreatment refers to a coating formed as a result of a chemical or electrochemical reaction between the metallic substrate and the surrounding environment. We have developed a new and novel conversion coating on copper alloys and other alloys. Laboratory corrosion testing has demonstrated the high corrosion resistance of the coating. In addition, the coating has a layered structure and is able to incorporate and release different types of ions through an ion-exchange process. The ion-exchanging property of the coating has been employed to incorporate/release corrosion inhibitors into/from the coating matrix. As a result, the coating showed self-healing corrosion protection.

Formation of a chemical conversion coating on metallic substrates involves the dissolution (i.e., corrosion) of the metal substrates, which also causes a change of the chemical environment near the metal surface, such as local pH and concentration of solution species. The change of local chemical environments near the metal surface leads to the simultaneous deposition of conversion coatings. Due to the relatively high stability of copper alloys, it is difficult to form chemical conversion coatings on copper alloy surfaces. To overcome the problem, we have used highly oxidative permanganates to promote the dissolution of copper alloys and to alter the local chemical environment near the copper alloy substrate.

Specifically, the current invention is the deposition of a conversion coating that is composed of hydrotalcite-like compound (HTlcs). HTlcs, also known as layered double hydroxides or anionic clays, represent a group of inorganic materials that are used in many applications. Their chemical composition is expressed by the general formula $M_{1-x}^{II}M_x^{III}(OH)_2A_{x/n}^{n-}yH_2O$, where $M^{II}$ and $M^{III}$ are divalent and trivalent metal cations and $A^{n-}$ is an n-valent anion (FIG. 1). The common divalent metal cations are Mg (II), Ni (II), Zn (II), and Cu (II); and the common trivalent cations are Al (III), Cr (III), Fe (III), and Ga (III). These types of HTlc conversion coatings have been deposited onto active metal surfaces such as aluminum alloys [see for example, R. G. Buchheit, S. B. Mamidipally, P. Schmutz, and H. Guan, *Corrosion,* 58, 3 (2002).] and galvanized steel [R. G. Buchheit and H. Guan, JCT Research, 1 (4), 277 (2004)], no work has been reported to prepare HTlcs conversion coatings on copper alloys, due partly to the reason that copper alloys are relatively stable in common chemical environments. In the current invention, the inability of conventional methods to form a conversion coating has been overcome through addition of highly oxidative permanganates to the treatment bath to promote the dissolution of copper alloys. The dissolution of copper forms $Cu^{II}$ cations that are building blocks of the HTlcs coating. Secondly, highly soluble aluminum salts, such as aluminum nitrates were added to the treatment solution. On one hand, the $Al^{III}$ cations are the building block of the HTlcs coating; on the other hand, the hydrolysis of the $Al^{III}$ cations causes the solution to be acidic, which promotes the dissolution of copper. Thirdly, carbonate anions were provided by adding sodium bicarbonate into the treatment bath. The carbonate anions are preferred anions for HTlcs formation.

Although the formulation was designed to form Al—Cu HTlcs, it was un-expected that one of the reduction products of the oxidative permanganates is $Mn^{II}$ cation, which is also the building block of the HTlcs coating. The resultant conversion coating is thus likely a mixture of Al—Cu and Al—Mn HTlcs. The coating was found to be electrochemically active with well-defined oxidation-reduction peaks in an inert NaCl solution. Although not clear at the moment, it is postulated that the multi-valence state characteristics of Mn elements (e.g., valence states of II, III, IV, VI and VII) in the HTlcs coating renders the coating to be electrochemically active. The electrochemical active characteristics of the coating suggests that the coating is electrically conductive, which is confirmed with four-point probe analysis.

In HTlcs, the $M_{1-x}^{II}M_x^{III}(OH)_2$ form layers with positive charges. The positive charges are balanced through intercalation with the $A_{x/n}^{n-}$ anions. The intercalation layer also contains $H_2O$ molecules. Due to the layered structure of the coating in the molecular level and the diversity of anions able to be intercalated in the interlayer, corrosion inhibitive ions can be incorporated into the coating through an ion-exchanging process. Benzotriazole, a common corrosion inhibitor for copper alloys was incorporated into the coating matrix as anions through ion-exchanging process at an alkaline environment. The benzotriazole-incorporated coatings showed damage-responsive corrosion protection (i.e., self-healing) for copper alloys.

The general formula to prepare the coatings consists of a water-borne bath consisting of 1) highly soluble salts to provide aluminum ions (Component A), 2) highly oxidative salts to accelerate the anodic dissolution of copper substrate and to provide manganese ions (Component B), and 3) highly soluble salts to provide anions, preferably carbonates (Component C). Highly soluble aluminum salts, such as aluminum nitrates (Al(NO3)3) can be used as Component A. Highly soluble and oxidative manganates such as potassium permanganate (KMnO4) and sodium permanganate (NaMnO4) can be used as Component B. Preferred salts for Component C are those that can provide carbonate ions in solution, such as sodium carbonate (Na2CO3) and sodium bicarbonate (NaHCO3). In addition, the bath needs to be heated to less than 100° C. to accelerate the coating formation process.

The coating can be conferred with self-healing functionality by incorporating corrosion inhibitors into the interlayers of the coating through an ion-exchanging process by immersing the coating in a solution containing corrosion inhibitors. Common copper corrosion inhibitors, such as different type of azoles, can be incorporated into the coating as anions at slightly alkaline environments, such as in a solution with pH adjusted slightly higher than 8.

BRIEF DESCRIPTION OF THE DRAWINGS

For a better understanding of the invention, reference is made to the following drawings which are to be taken in conjunction with the detailed description to follow.

DESCRIPTION OF THE PREFERRED EMBODIMENTS

Overview

Figure 1:
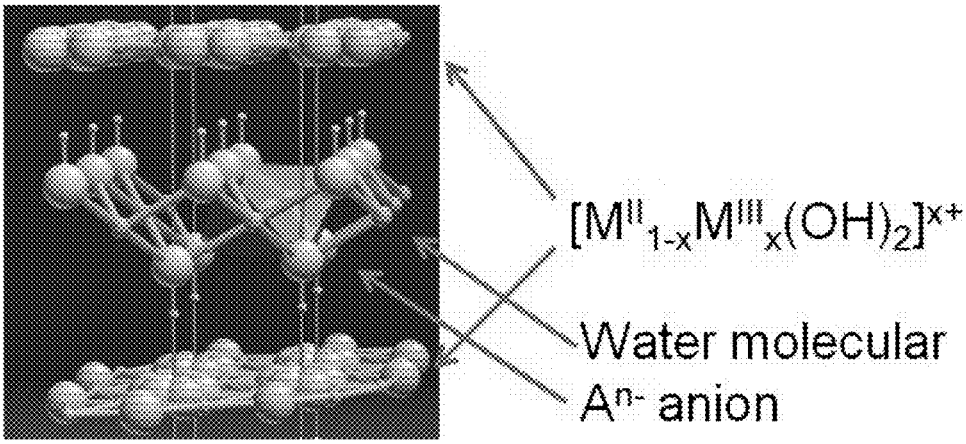
FIG. 1: Schematic of the structure of HTlcs.
Figure 2:
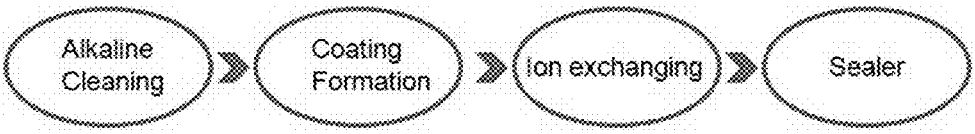
FIG. 2: Flow diagram of coating process.

A. A typical coating or surface treatment formulation is composed of 1 wt % $Al(NO_3)_3.9H_2O$, 1 wt % $KMnO_4$ and 0.2 wt % $NaHCO_3$ dissolved in DI water. The pH of the solution is approximately 3.5, due to the hydrolysis of $Al^{3+}$ ions. A typical coating process includes the following steps: 1) alkaline cleaning, 2) pretreatment in the formulated bath at elevated temperature, 3) ion-exchanging in a solution containing corrosion inhibitive species, and 4) application of a surface sealer (FIG. 2).

The alkaline cleaning procedure will remove oil and grease. Pickling of the panels was found to be not necessary as the panels and tubes we used were not covered with thick mill scales. In addition, the treatment solution is acidic and the thin oxide films are effectively removed during the coating formation process. The pretreatment usually involves the immersion of the cleaned panels in the formulated bath for 5-10 minutes at a temperature around 80° C. Heating is required to accelerate the corrosion of copper alloys and consequently the formation of the conversion coating. A longer treatment time is required at lower bath temperatures. After a certain period of time, the coating process gradually slows down. As a result, prolonged treatment time does not lead to a thicker coating. An ion-exchange process is used to incorporate corrosion inhibiting species into the coating matrix to add self-healing corrosion protection functionality to the coating. A typical ion-exchange solution consists of benzotriazole and NaOH with solution pH adjusted to 11. Application of a surface sealer is done to fill the micro-cracks of the conversion coating and to improve the barrier properties of the coating. The conversion coating adheres firmly both to the substrate and to the surface sealer. A commercial Coricone 1700 was used. Application of the sealer involves simple dipping of coated panels in a low viscosity commercial sealer, followed by heating at 100° C. for 15 minutes. A uniform thickness coating system can thus be obtained.

Figure 3:
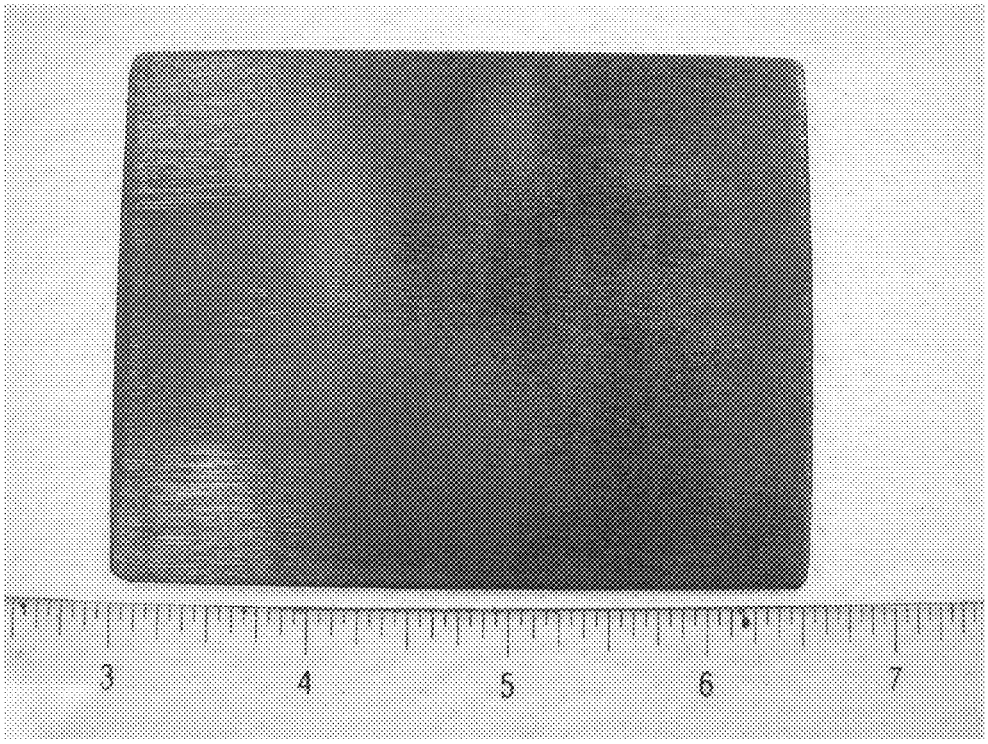
FIG. 3: Photograph of the conversion coating on Cu—Ni 90/10 alloy.
Figure 4A:
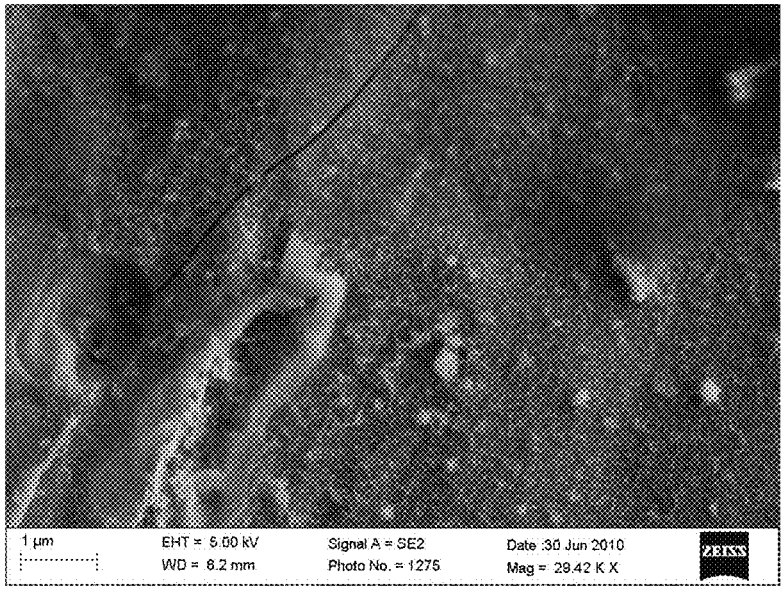
FIG. 4: SEM images of conversion coatings on Cu—Ni 90/10 alloy.
Figure 4:
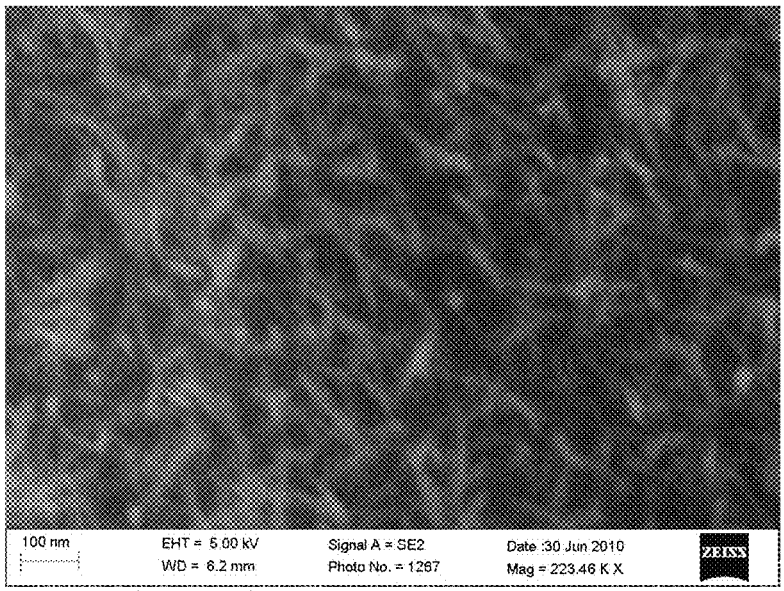

B. A defect-free purple coating can thus be formed onto Cu—Ni 90/10 alloy (FIG. 3). The microstructure of the coating was examined with scanning electron microscopy (SEM) (FIG. 4). The SEM images depicted some micro-cracks (FIG. 4*a*). On top of the coating, some whisker-like precipitates with nano-structures were also observed (FIG. 4*b*).

C. The coating formation mechanism is postulated as follows: The relatively high acidity of the solution and the high oxidative power of $KMnO_4$ and $Al(NO_3)_3.9H_2O$ causes the copper alloy substrate to corrode, whereas permanganate and nitrate ions are reduced inducing localized alkalinity. In alkaline environments, $Al^{3+}$, $Mn^{2+}$ (as a result of permanganate reduction), carbonates and hydroxyl ions co-precipitate to form Al—Mn hydrotalcites; the $Al^{3+}$, carbonates and hydroxyl ions also co-precipitate with $Cu^{2+}$ ions (due to dissolution of Cu) to form Al—Cu hydrotalcites. The coating thus likely is composed of mixed hydrotalcites.

Figure 5:
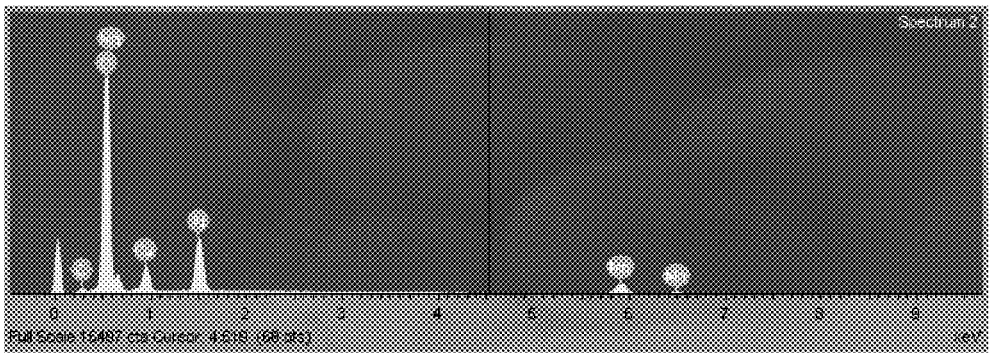
FIG. 5: EDXA spectrum of conversion coating covered Cu—Ni 90/10 alloy.
Figure 6:
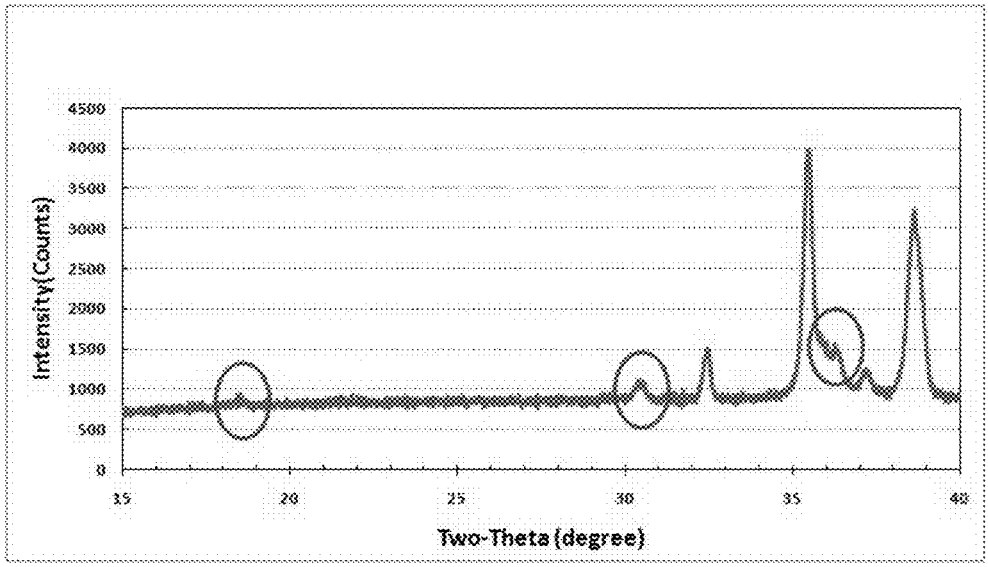
FIG. 6: XRD pattern of Cu—Ni 90/10 alloy coated with conversion coating, heated at 550° C. in air for 6 hours. The peaks marked are typical of $MnAlO_2$ spinel, and the ratios of peak intensities are in good agreement with the prediction value.

The energy-dispersive X-ray analysis (EDXA) spectrum (FIG. 5) showed C, O, Al and Mn peaks as well as Cu peak. The Cu peaks may be partially originated from the substrate as the film is thin and is in the range of 200-300 nm. The X-ray diffraction (XRD) pattern of the coated sample showed only the peaks of the substrate alloy, suggesting that the film is largely amorphous. It is well-known that the amorphous hydrotalcites may transform to spinels upon heat-treatment. After heat treatment of the coated sample at 550° C. for 6 hours, the XRD patterns showed the presence of $MnAlO_2$ spinels as well as other un-identified phases (FIG. 6), suggesting that the coating before heat treatment consists of Al—Mn hydrotalcite-like compounds as well as other phases.

Figure 7:
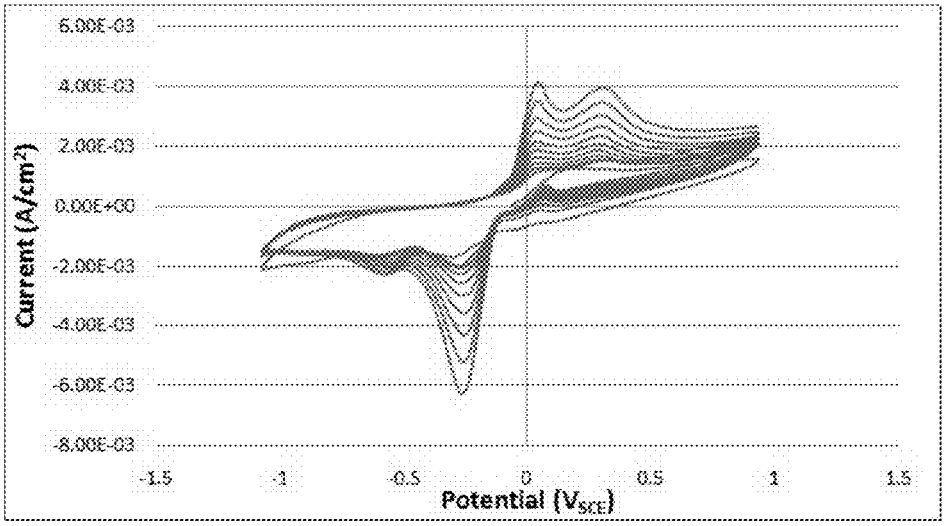
FIG. 7: Cyclic voltammograms of (a) coated Cu—Ni 90/10 sample and (b) bare Cu—Ni 90/10 sample in an air-exposed 3.5 wt % NaCl solution.
Figure 7:
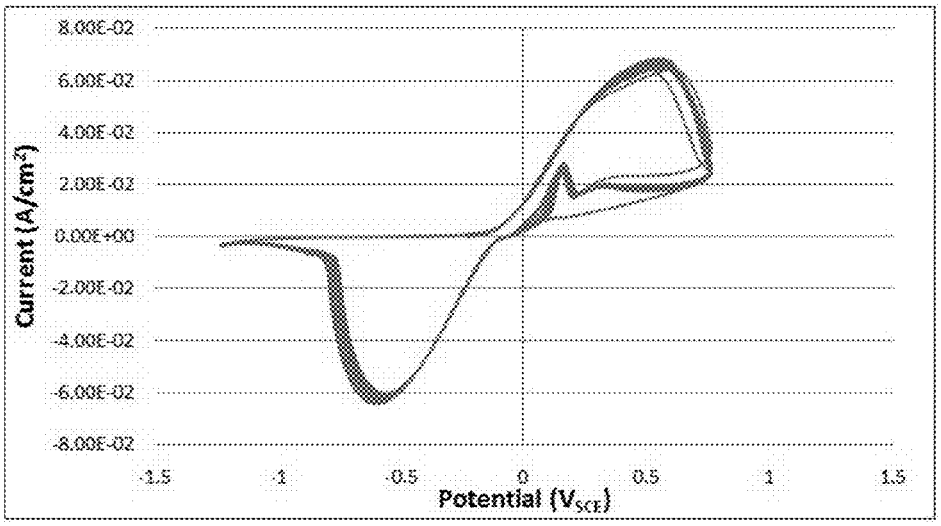
Figure 8:
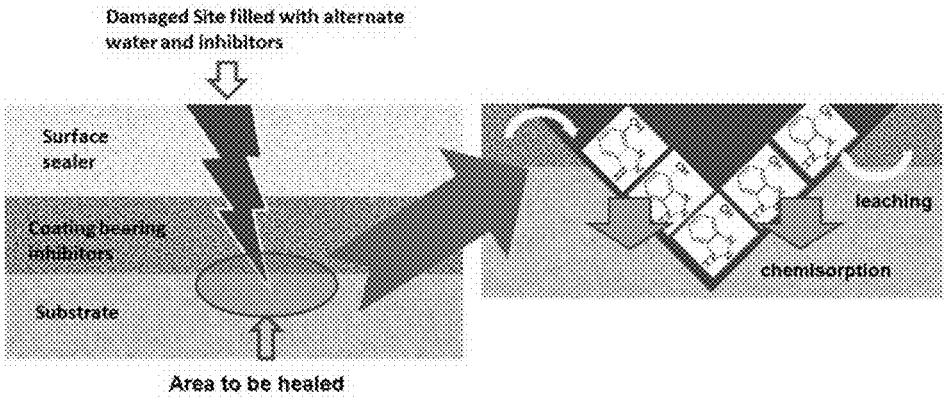
FIG. 8: Schematic of self-healing corrosion protection.

D. Surprisingly, the coating was electrochemically active as demonstrated by electrochemical methods. The cyclic voltammograms (CVs) of the coated alloy and the bare alloy in an inert NaCl solution are shown below in FIG. 7. The CV curves of the coated sample in an inert electrolyte solution showed well-defined oxidation and reduction peaks (FIG. 7*a*). The current density keeps increasing with increased CV scans. In contrast, the bare sample showed only one broad anodic peak and a broad cathodic peak (FIG. 7*b*). The broad anodic peak corresponds to the anodic dissolution of Cu and Ni, and the cathodic peak corresponds to the reduction of the dissolved Cu and Ni cations. The much lower anodic and cathodic current density of the coated sample suggests that the anodic dissolution (corrosion) of Cu—Ni alloy is greatly suppressed by the coating. The distinct CV characteristics of the coated sample clearly indicate that the coating is electrochemically active. Although the origin of the oxidation-reduction mechanism is not clear, it is likely that the oxidation-reduction process correspond to the changes of valence states of the multi-valence state Mn element in the coating. This implies that ions can migrate in and out of the coating matrix to balance the positive or negative charge, as the case may be. Thus, the conversion coating provides the basis for a self-healing coating. The self-healing corrosion protection mechanism is sketched in FIG. 8. Molecular structure of benzotriazole has been used for illustration of leaching and chemisorption. The adsorbed layer isolates the substrate from corrosive media and inhibits the corrosion of the substrate. Some corrosion inhibitors react with the substrate to form a protective coating.

The diagram depicts that the inhibitive species are retained in the coating when the coatings are intact. When there is an accidental damage to the coating, at the defect site, the inhibitive species leach out from the coating and inhibit the corrosion of the defect.

EXAMPLE 1

Figure 9:
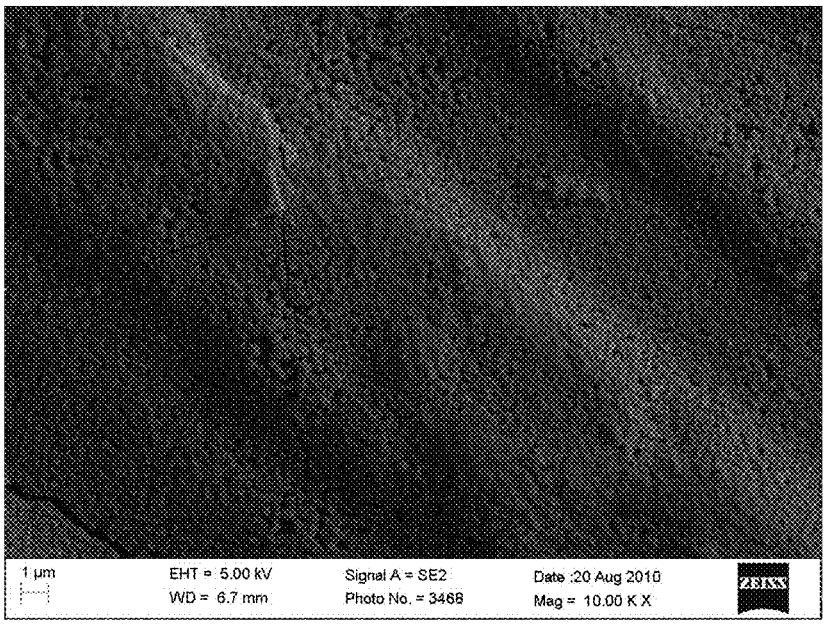
FIG. 9: SEM micrographs of (a) coated and (b) bare Cu—Ni 90/10 samples after 10 CV cycles in 3.5 wt % NaCl solution.
Figure 9:
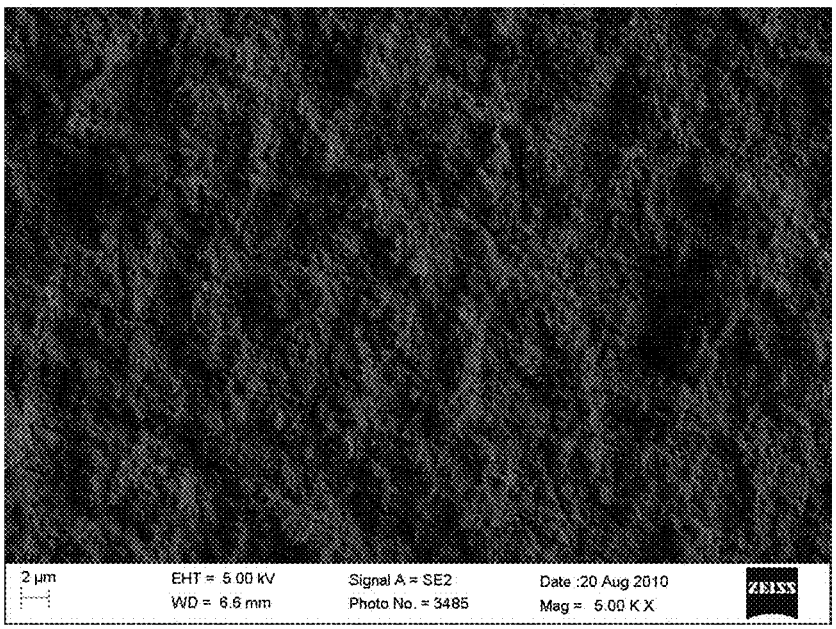

Corrosion Resistance of the Coating in Synthetic Recycled Water 1.a. The Barrier Properties of the Coating Demonstrated with Cyclic Polarization In fact, the CV tests (depicted in FIG. 7) are destructive for normal coatings applied to metal substrates. The anodic CV scan corresponds to anodic polarization; and the cathodic CV scan corresponds to cathodic disbondment. After 10 CV cycles, the bare sample was heavily corroded, whereas the coated sample showed no noticeable defects. This visual observation was further confirmed with SEM micrographs (FIG. 9).

1.b. Immersion Corrosion Testing

Due to the fact that the composition of real recycled water varies from site to site, and from time to time, it is impractical to use real recycled water for the assessment of corrosion mechanism of bare alloys and the corrosion protection properties of coatings under development. Therefore, we used a composition of synthetic recycled water based on an analysis on the composition of typical waste water and the key elements that affect corrosion. The composition of the synthetic recycled water is shown in Table 1.

TABLE1

Proposed composition of synthetic waste water for corrosion measurements

| | NaCl | Ammonia | $FeCl_3$ | pH |
|---|---|---|---|---|
| Concentration | 1 g/L | 0.001M | 0.0001M | As is |

The selection of NaCl as the main electrolyte is based on the fact that this compound is the most commonly dissolved salts in waste water. The concentration was set at 1 g/L as the concentration of total dissolved salts in industrial waste water is often close to this value. Such concentration will, on one hand, provide sufficient ionic conductivity to facilitate electrochemical corrosion of alloys; and, on the other hand, provide the aggressive ions (i.e., $Cl^-$ ions) for the corrosion of many alloys, such as copper alloys and steel.

Ammonia is one of the most common species in waste water, and is often the cause for the accelerated corrosion of copper and its alloys. In typical waste water, the concentration of ammonia is around 0.001 M.

The concentration of $FeCl_3$ in this synthetic formulation is much higher than that in real waste water. However, the selection of this compound at this concentration is intended to "represent" the total oxidative power of the waste water, which often contains other oxidative species, such as silver, perchlorate and copper. In addition, the concentration of this species is indirectly related to the rate of corrosion. The Nernst equation predicts that the electrochemical potential of $Fe^{3+}/Fe^{2+}$ couple changes only 0.059 V per decade of concentration variation.

Figure 10:
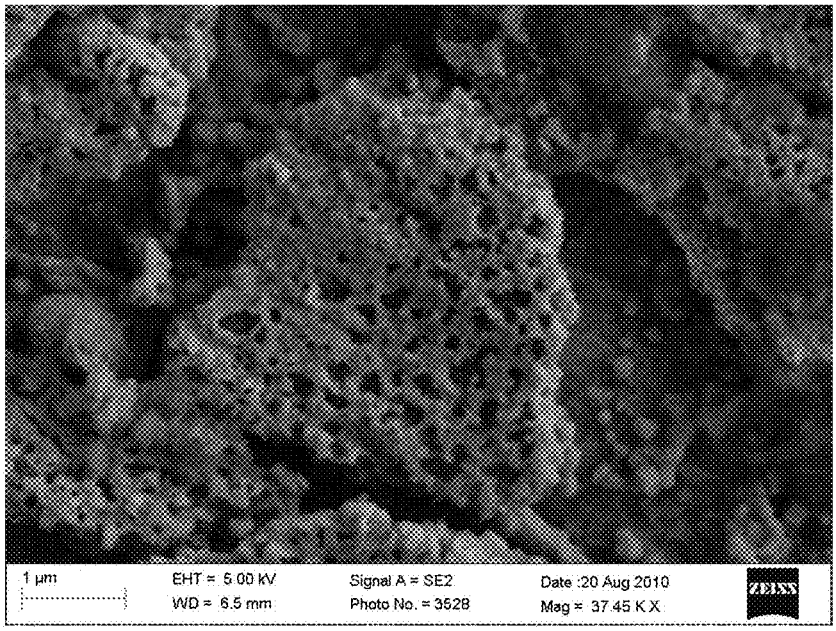
FIG. 10: SEM images of corrosion morphologies for (a) bare Cu—Ni 90/10 sample after three days in synthetic water and (b) coated Cu—Ni 90/10 sample after 8 days in synthetic water.
Figure 10:
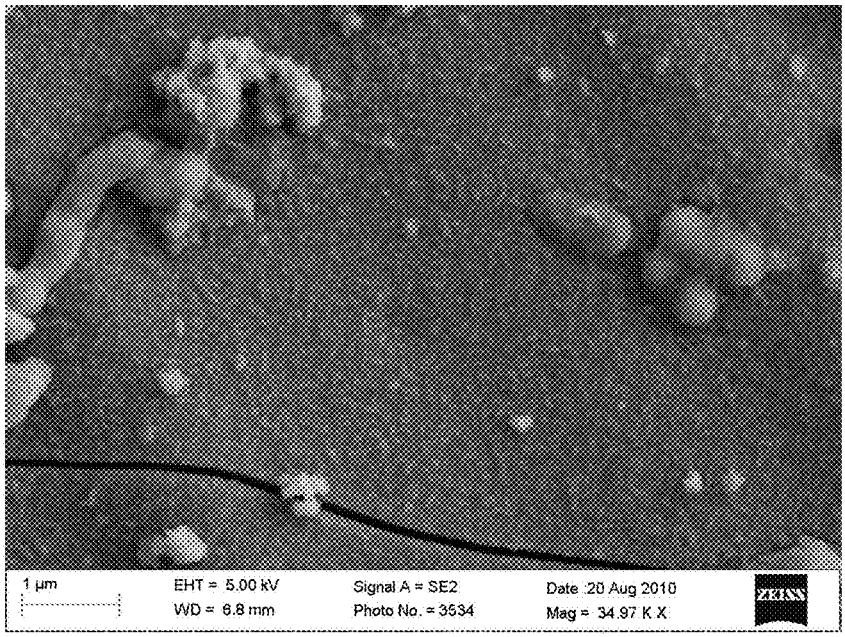

The barrier property of the coating as corrosion protection layer for copper alloys in reclaimed water was demonstrated through immersion experiments by using the synthetic water as corrosion media. For bare panels, after few hours of immersion in the synthetic water, corrosion was observed. In contrast, the coated sample showed negligible corrosion except for the sharp edges. The corrosion morphologies of the bare sample and the coated sample after several days of immersion in the synthetic waste water were examined with SEM (FIG. 10).

The SEM micrographs show a rough surface of the bare panel after three days in synthetic water; whereas the coated sample had only some precipitates formed on the coating surface after 8 days immersion in the synthetic water.

1.c. Enhancement of Corrosion Resistance with Sealer

Figure 11:
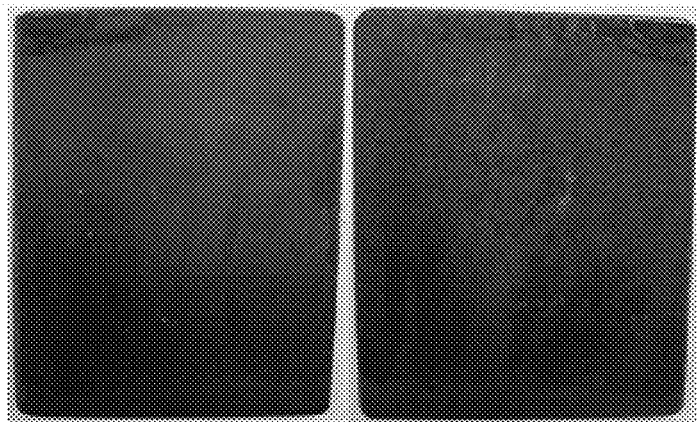
FIG. 11: Images of conversion coated and sealed Cu—Ni 90/10 sample after 14 days in synthetic water.

The corrosion resistance of the coated sample can be further enhanced through the application of a surface sealer—a common practice for pretreatments. A chromate-free commercial sealer (Corro Therm, Inc) was applied on the coated sample through simple immersion and heating at 150° C. for 10 minutes. Immersion of the coated and sealed Cu—Ni 90/10 sample in the synthetic waste water for 14 days showed no sign of corrosion (FIG. 11).

In fact, a negligible weight change of the samples after removal from the corrosion media is observed (Table 3). After removal of the samples from the corrosion media, the samples were thoroughly rinsed with DI water and dried in the air for one day before measuring the final weight. The slight weight gain may be due to the precipitation of Fe-containing species from the synthetic water.

TABLE 2

Sample weights before and after immersion in corrosion media.

| | Initial weight (grams) | Weight after immersion (grams) |
|---|---|---|
| Sample 1 | 28.456 | 28.458 |
| Sample 2 | 25.045 | 25.047 |

EXAMPLE 2

Self-Healing Corrosion Protection

The ion-exchanging capability of the coating suggests that corrosion inhibitive ions for copper alloys may be incorporated into the coating using an ion-exchanging process. It is anticipated that the incorporated inhibitive ions may leach out at sites where corrosion initiates. The leached inhibitive ions may thus provide self-healing corrosion protection.

Figure 12:
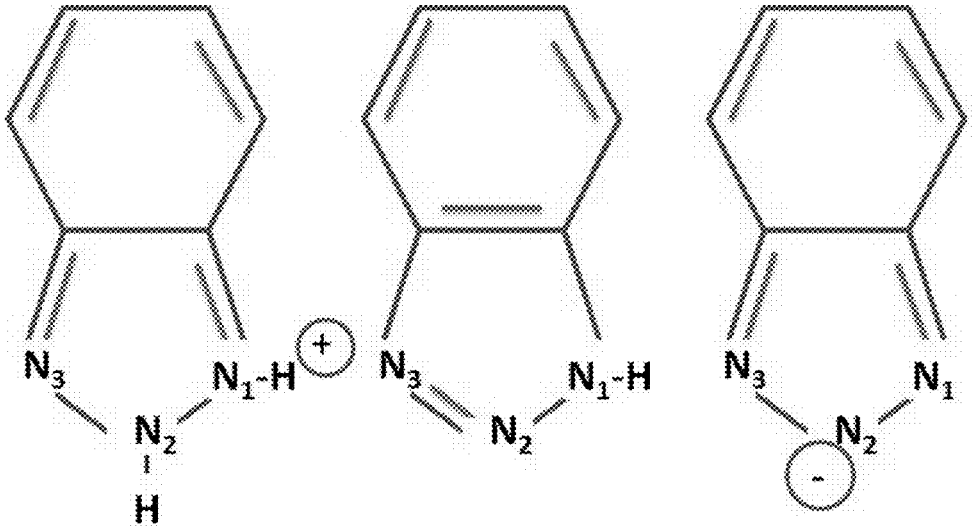
FIG. 12: Schematic diagram depicting the status of BTA as a function of solution pH. At low pH, BTA becomes a cation; while at high pH, BTA becomes an anion.

On the other hand, it has been demonstrated that benzotriazole (BTA) is a very effective corrosion inhibitor for copper alloys. [E. Cano, J. L. Polo, A. La Iglesia and J. M. Bastidas, Chemistry and Materials Science, 10 (3), 219 (2004)] In addition, it is known that BTA may become cations or anions depending on the solution pH (FIG. 12). [Desmond Tromans and Ru-hong Sun, J. Electrochem. Soc., Volume 138, Issue 11, pp. 3235-3244 (1991)]

We attempted to incorporate BTA into the coating through ion-exchanging process in a BTA-containing solution with high pH. After ion-exchanging process, the samples were tested in synthetic water through immersion, in salt fog chamber, and in humidity chamber. Some of the results are shown below.

2.a. Self-Healing Demonstrated with Salt Fog Test

Figure 13:
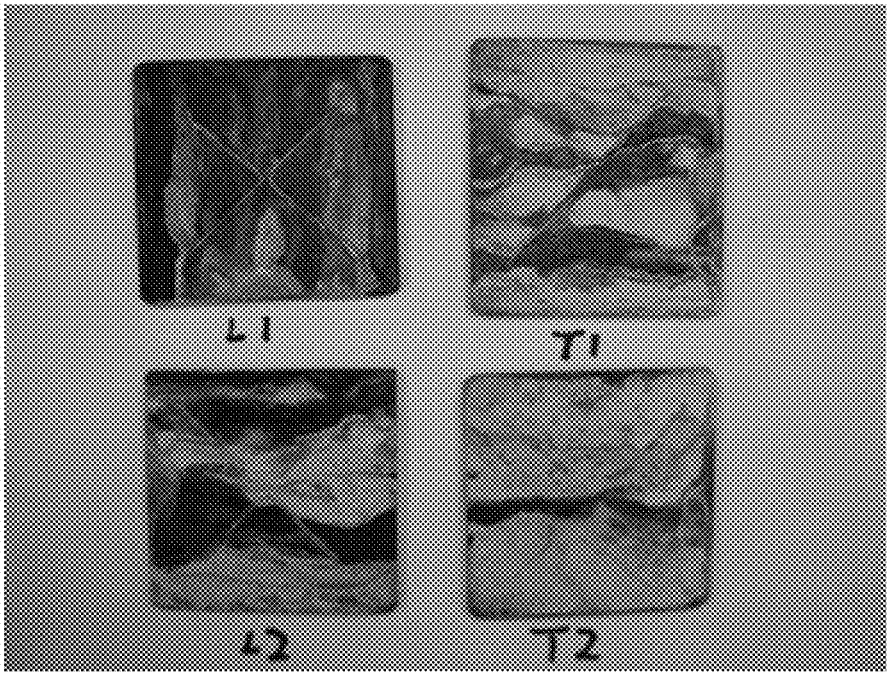
FIG. 13: Corrosion morphologies of coated Cu—Ni 90/10 panels after 10 days in salt fog chamber. T1 and T2 are samples immersed for three days in a pH 11 NaOH solution before the salt fog test; L1 and L2 are samples immersed for three days in a pH 11 NaOH solution containing BTA.

The corrosion morphologies of the coated Cu—Ni 90/10 samples after 10 days in salt fog chamber were recorded (FIG. 13). It is clearly seen that the extent of corrosion for the samples treated in NaOH solutions containing BTA is much less that those treated without BTA. The results suggest that the ion-exchanging process is effective in incorporating BTA into the coating and that the incorporated BTA can provide corrosion protection to the material.

2.b. Self-Healing Demonstrated with Immersion Test

Figure 14:
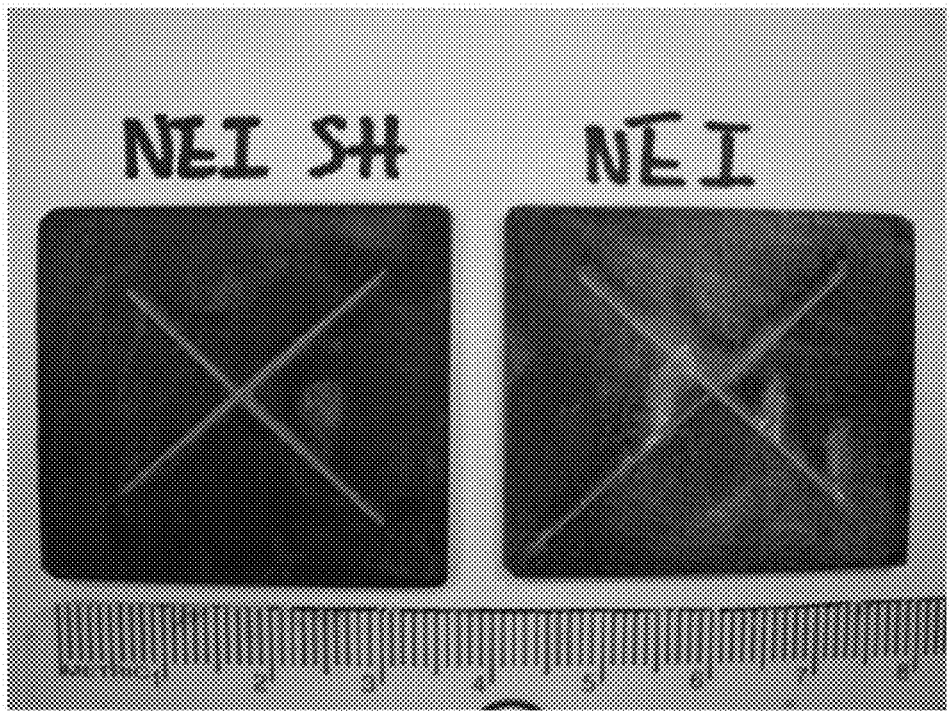
FIG. 14: Images of coated Cu—Ni 90/10 panels after 5 hours in synthetic water. Sample on left was ion-exchanged for three days in pH 11 solution; sample on right was in pH 11 solution without BTA for three days.

The self-healing effect of the coating after the ion-exchanging process is also demonstrated by the immersion tests (FIG. 14). After 5 hours immersion in synthetic water, the sample treated in pH 11 NaOH solution without BTA showed corrosion along the scribe lines; whereas, the extent of corrosion of the sample treated in pH 11 NaOH solution with BTA added was much less.

2.c. Self-Healing Demonstrated with Corrosion Cabinet Test

Figure 15:
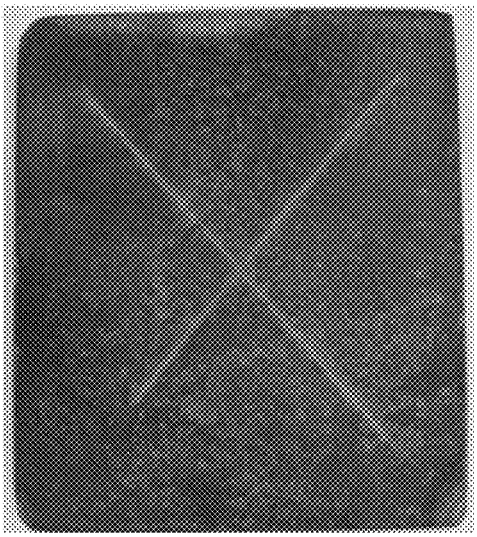
FIG. 15: Images of coated Cu—Ni 90/10 panels after 11 days in corrosion cabinet. Sample on right was ion-exchanged for three days in pH 11 solution; sample on left was in pH 11 solution without BTA for three days.
Figure 15:
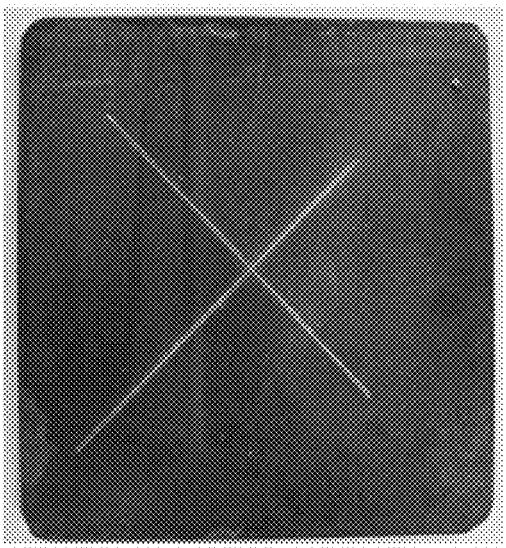

The self-healing effect of the coating after the ion-exchanging process is further demonstrated with corrosion cabinet testing (FIG. 15). After the samples were treated as those in FIG. 14, the samples were immersed in synthetic water for five minutes and then transferred to the corrosion cabinet. After 11 days, the sample treated in pH 11 NaOH solution without BTA showed corrosion along the scribe lines as well as other areas. On the other hand, no sign of corrosion was observed for the sample treated in pH 11 NaOH solution with the addition of BTA.

2.d. Self-Healing Demonstrated with Sealed Samples

Figure 16:
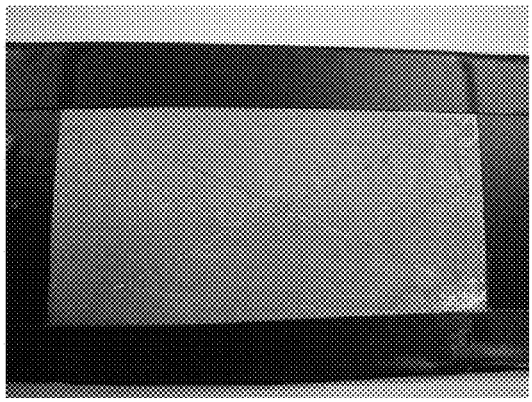
FIG. 16: Images of Cu—Ni 90/10 panels after 60 hrs in salt spray chamber: (a) sealed bare panel; (b) the panel was coated and then immersed in pH 11 NaOH solution for two days, and finally sealed; (c) the panel was coated and then immersed in pH 11 NaOH solution plus 0.05 M BTA for two days, and finally sealed. After removal from the salt spray chamber, all the samples were ultrasonically cleaned in DI water.
Figure 16:
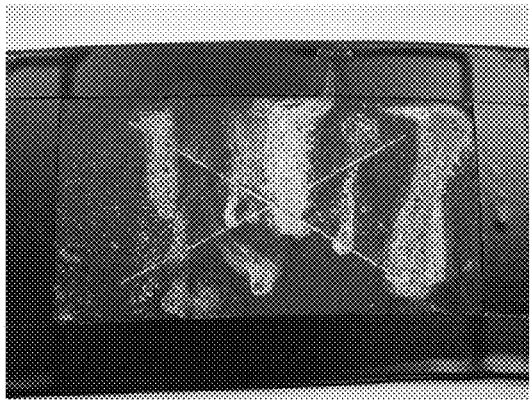
Figure 16:
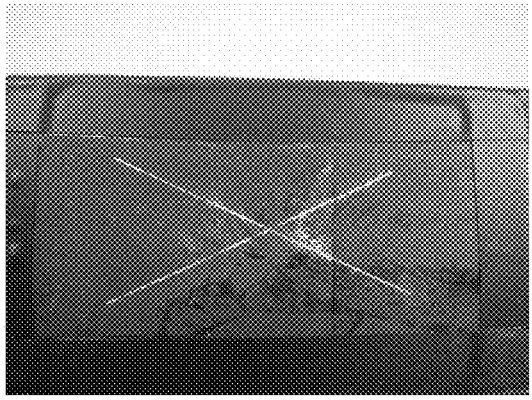

Finally, the self-healing effect of ion-exchanging process to the coating was also observed on sealed samples. The bare panels, the coated panels with two days immersion in pH 11 NaOH solution, and the coated panels with two days immersion in pH 11 NaOH solution plus 0.05 M BTA (ion-exchanging) were subjected to salt spray test for 60 hours (FIG. 16).

A clear trend is observed as follows: for the sealed bare panel, corrosion was observed all over the whole sample surface; for the coated, pH 11 NaOH solution treated and finally sealed sample, the surface was partially covered with corrosion products; for the ion-exchanged sample, the surface was mostly intact.

EXAMPLE 3

Heat Transfer Resistance Measurement

Figure 17:
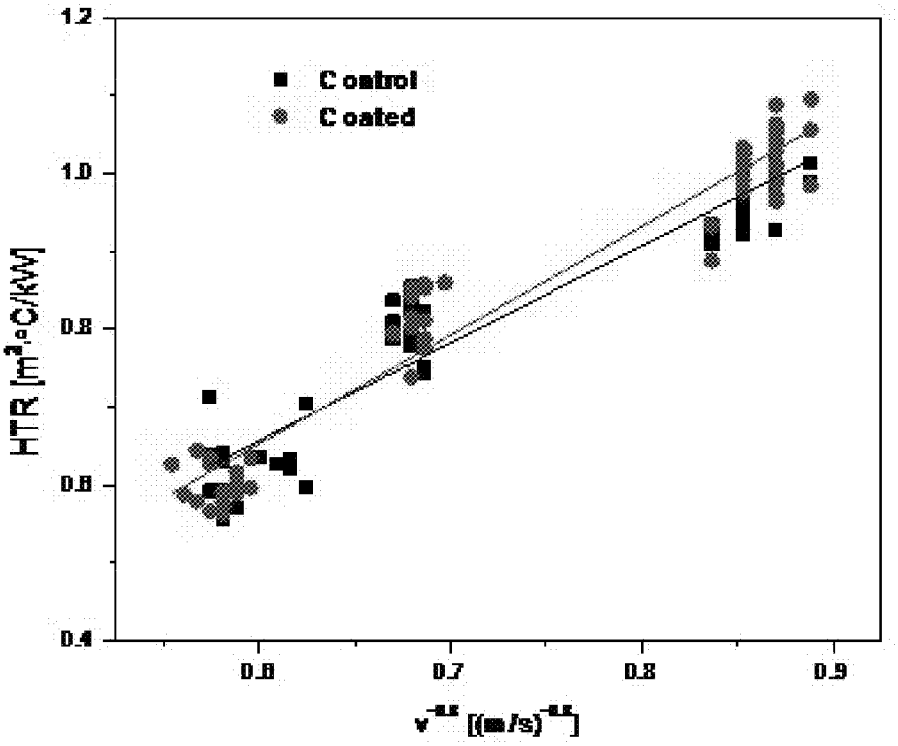
FIG. 17: Wilson plots of the coated and uncoated Cu/Ni 90-10 tubes.

One of the objectives of the present invention was to develop a coating that will enable the use of alternative water in cooling applications. The results presented above demonstrate the good corrosion resistance of a chemical conversion coating for Cu—Ni 90/10 alloy, which is a typical material used for the construction of heat exchanger tubes. To demonstrate the applicability of this new coating technology in heat exchanger tubes, we successfully coated the inside surface of a 30-inch long (¾" ID) Cu/Ni 90/10 tube and measured the overall heat transfer resistance (HTR) of the coated and uncoated tubes with an in-house built apparatus. FIG. 17 compares the overall HTR of the coated and uncoated tubes as a function of $V^{-0.8}$, where V is the flow rate of cooling water. Essentially no difference on HTR was observed for the coated and uncoated tubes.

EXAMPLE 4

The Universal Aspect of the Coating Formulation

Figure 18:
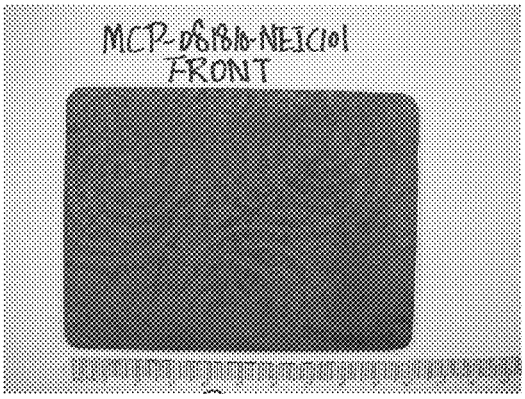
FIG. 18: Images of coated panels. (a) AZ91D Mg alloy; (b) 6061 Al alloy; (c) carbon steel
Figure 18:
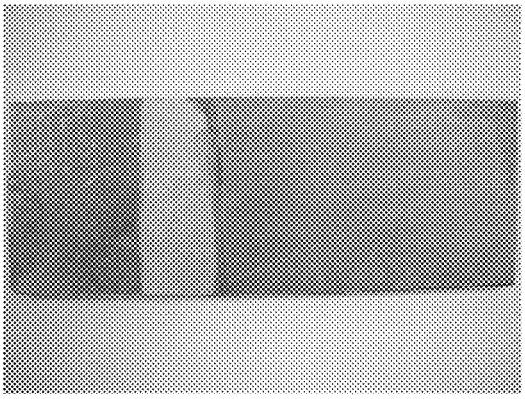
Figure 18:
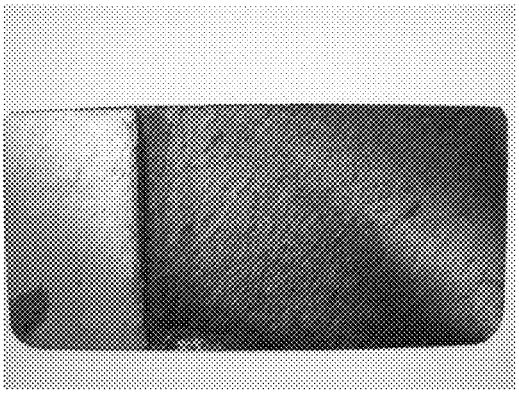

It is to be noted that the formulation developed for coating copper alloys can also be used on magnesium alloys, aluminum alloys and steels through simple immersion of the pre-cleaned substrates into the bath at a temperature over 80° C. for 10 minutes (FIG. 18). Aluminum alloys and steels are also used in heat exchanging tubes. Hence, the coating technology developed could be further explored for protecting other heat exchanging materials.

In summary, the general formula to prepare the coatings consists of a water-borne bath consisting of 1) highly soluble salts to provide aluminum ions (Component A), 2) highly oxidative salts to accelerate the anodic dissolution of copper substrate and to provide manganese ions (Component B), and 3) highly soluble salts to provide anions, preferably carbonates (Component C). Highly soluble aluminum salts, such as aluminum nitrates (Al(NO3)3) can be used as Component A. Highly soluble and oxidative manganates such as potassium permanganate (KMnO4) and sodium permanganate (NaMnO4) can be used as Component B. Preferred salts for Component C are those that can provide carbonate ions in solution, such as sodium carbonate (Na2CO3) and sodium bicarbonate (NaHCO3). In addition, the bath needs to be heated to less than 100° C. to accelerate the coating formation process.

Further, the coating can be conferred with self-healing functionality by incorporating corrosion inhibitors into the interlayers of the coating through an ion-exchanging process by immersing the coating in a solution containing the inhibitors. Common copper corrosion inhibitors, such as different type of azoles, can be incorporated into the coating as anions at slightly alkaline environments, such as in a solution with pH adjusted slightly higher than 8.

As is well known the formula parameters set forth herein are for example only, such parameters can be scaled and adjusted in accordance with the teachings of this invention. The invention has been described with respect to preferred embodiments. However, as those skilled in the art will recognize, modifications and variations in the specific details which have been described and illustrated may be resorted to without departing from the spirit and scope of the invention as defined in the appended claims.

What is claimed is:

1. A non-chromate conversion coating formulation for copper and copper alloy substrates comprising:

a) water soluble salts to provide aluminum ions, said water soluble salts forming an acidic coating solution;

b) oxidative water soluble salts to accelerate the anodic dissolution of copper substrate and to provide manganese ions;

c) water soluble salts in the form of carbonates to provide anions;

d) upon application to the substrate, forming a conversion coating being electrochemically active and electrically conductive and having a hydrotalcite-like structure.

2. The conversion coating formulation as claimed in claim 1 wherein the salts providing aluminum ions comprise at least one of: aluminum nitrates, aluminum chlorides, aluminum sulfates, and aluminum perchlorates.

3. The conversion coating formulation as claimed in claim 1 wherein the oxidative water soluble salts to accelerate the anodic dissolution of copper substrate and to provide manganese ions comprise at least one of: potassium permanganate ($KMnO_4$) and sodium permanganate ($NaMnO_4$).

4. The conversion coating formulation as claimed in claim 1 wherein the carbonates comprise at least one of sodium carbonate ($Na_2CO_3$) and sodium bicarbonate ($NaHCO_3$).

5. The conversion coating formulation as claimed in claim 1 wherein the hydrotalcite-like compound is a mixture of Al—Mn and Al—Cu hydrotalcites.

6. The conversion coating formulation as claimed in claim 1 wherein the coating, after application to the substrate, further includes corrosion inhibitors to provide self-healing corrosion protection.

7. The conversion coating formulation as claimed in claim 6 wherein the corrosion inhibitors comprise azoles.

8. The conversion coating formulation as claimed in claim 7 wherein the corrosion inhibitors comprises benzotriazole.

9. The conversion coating formulation as claimed in claim 1 wherein the water soluble salts to provide aluminum ions and the oxidative water soluble salts have a concentration ranging from 0.1 g/L to 10 g/L.

10. The conversion coating formulation as claimed in claim 1 wherein the water soluble salts to provide anions have a concentration ranging from 0.5 g/L to 2 g/L.

11. The conversion coating formulation as claimed in claim 1 wherein the coating includes nano-structured morphologies.

12. The conversion coating as formulation claimed in claim 1 wherein the pH of the acidic coating is approximately 3.5.

13. An electrochemically active conversion coating formulation for copper and copper alloy substrates, formed by an acidic coating formulation comprising:

(a) aluminum nitrate to provide aluminum ions;

(b) potassium permanganate to provide manganese ions and accelerate the anionic dissolution of copper substrate;

(c) sodium carbonate to provide anions;

(d) upon application to the substrate, forming a conversion coating being electrochemically active and electrically conductive and having a hydrotalcite-like structure.

14. The conversion coating formulation as claimed in claim 13 wherein the coating further includes corrosion inhibitors, which provides self-healing corrosion protection for the copper and copper alloys.

15. The conversion coating formulation as claimed in claim 14 wherein the corrosion inhibitors comprise azoles.

16. The conversion coating formulation as claimed in claim 15 wherein the corrosion inhibitors comprises benzotriazole.

17. The conversion coating formulation as claimed in claim 13 wherein the coating includes nano-structured morphologies.

* * * * *